US006730640B2

(12) United States Patent
Sowerby et al.

(10) Patent No.: US 6,730,640 B2
(45) Date of Patent: May 4, 2004

(54) METHOD FOR LUBRICATING A CONTINUOUSLY VARIABLE TRANSMISSION

(75) Inventors: Roger L. Sowerby, Concord, OH (US); Craig D. Tipton, Perry, OH (US); James L. Sumiejski, Mentor, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 46 days.

(21) Appl. No.: 10/166,451

(22) Filed: Jun. 10, 2002

(65) Prior Publication Data

US 2002/0183210 A1 Dec. 5, 2002

Related U.S. Application Data

(62) Division of application No. 09/694,704, filed on Oct. 23, 2000, now abandoned.

(51) Int. Cl.[7] ..... C10M 129/26; C10M 137/06

(52) U.S. Cl. ..... 508/371; 508/539; 252/74

(58) Field of Search ..... 508/371, 539

(56) References Cited

U.S. PATENT DOCUMENTS

| | | | | | |
|---|---|---|---|---|---|
| 3,259,583 | A | * | 7/1966 | Sprague et al. | 252/75 |
| 3,297,573 | A | * | 1/1967 | Hain et al. | 252/325 |
| 3,411,369 | A | * | 11/1968 | Hammann et al. | 74/200 |
| 3,489,682 | A | * | 1/1970 | LeSuer | 252/32.7 |
| 3,627,681 | A | | 12/1971 | Chandler | 252/32.7 E |
| 3,676,342 | A | * | 7/1972 | Gathman et al. | 252/18 |
| 3,803,037 | A | * | 4/1974 | Wygant | 252/32.7 |
| 4,693,134 | A | * | 9/1987 | Kraus | 74/690 |
| 4,704,216 | A | * | 11/1987 | Hata et al. | 252/32.7 |
| 4,704,490 | A | * | 11/1987 | Tsubouchi et al. | 585/1 |
| 4,792,410 | A | * | 12/1988 | Schwind et al. | 252/38 |
| 5,043,497 | A | * | 8/1991 | Muraki et al. | 508/186 |
| 5,064,546 | A | * | 11/1991 | Dasai | 252/32.5 |
| 5,110,488 | A | * | 5/1992 | Tipton et al. | 252/32.7 E |
| 5,391,307 | A | * | 2/1995 | Yamazaki et al. | 252/32.5 |
| 5,604,188 | A | * | 2/1997 | Ryan | 508/371 |
| 5,750,477 | A | * | 5/1998 | Sumiejski et al. | 508/331 |
| 5,902,776 | A | * | 5/1999 | Dohner | 508/376 |
| 6,103,673 | A | * | 8/2000 | Sumiejski et al. | 74/690 |
| 2002/0032129 | A1 | | 3/2002 | Tersigni et al. | 508/421 |

FOREIGN PATENT DOCUMENTS

| | | | |
|---|---|---|---|
| EP | 0 287 618 B1 | * | 12/1992 |
| EP | 0 761 805 | * | 3/1997 |
| EP | 761 806 | | 3/1997 |
| EP | 0 805 194 A1 | * | 11/1997 |
| JP | 9-78079 | | 3/1997 |
| JP | 9 078079 | * | 3/1997 |

* cited by examiner

*Primary Examiner*—Ellen M McAvoy
(74) *Attorney, Agent, or Firm*—David M. Shold; Michael F. Esposito

(57) ABSTRACT

Continuously variable transmissions are lubricated by supplying to the transmission a composition of an oil of lubricating viscosity and an oil-soluble zinc salt containing at least one hydrocarbyl group of at least 4 carbon atoms. The amount of the zinc salt is sufficient to provide an increased steel-on-steel dynamic coefficient of friction for the composition, being at least 0.125. The composition is substantially free from thiophosphate salts and exhibits a copper corrosion rating of 1B or better (ASTM-130).

21 Claims, No Drawings

METHOD FOR LUBRICATING A CONTINUOUSLY VARIABLE TRANSMISSION

This application is a continuation of Ser. No. 09/694,704 filed Oct. 23, 2000 now abandoned.

BACKGROUND OF THE INVENTION

The present invention relates to compositions useful as transmission fluids, and particularly as fluids for continuously variable transmissions, and their use in lubricating continuously variable transmissions.

Continuously variable transmissions (CVT) represent a radical departure from conventional automatic transmission. The "push belt" version of the CVT was invented by Dr. Hub Van Doorne, and since its introduction, many cars have been equipped with the push belt CVT system. CVTs are manufactured by Van Doorne's Transmissie VB of Tilburg, the Netherlands. A more detailed description of such transmissions and belts and lubricants employed therein is found in U.S. Pat. No. 5,750,477, as well as references cited therein. In brief, a belt and pulley system is central to the operation of this type of transmission. The pulley system comprises a pair of pulleys with a V-shaped cross-section, each consisting of a moveable sheave, a fixed sheave, and a hydraulic cylinder. Between the pulleys runs a belt, which consists of a set of metal elements held together by metal bands. In operation, the driving pulley pushes the belt to the driven pulley, thereby transferring power from the input to the output. The transmission drive ratio is controlled by opening or closing the moveable sheaves so that the belt rides lower or higher on the pulley faces. This manner of operation permits continuous adjustment of gear ratio between the input and output shafts. Other types of belt-driven continuously variable transmissions are also known, including "pull-belt" transmissions in which a belt transmits force in tension rather than compression.

It has become clear from commercial use of the CVT that the fluids used in the CVT are just as important as the mechanical design for satisfactory operation. The lubricant must fulfill several functions: to lubricate the metal belt in its contacts with the pulley assembly, the planetary and other gears, the wet-plate clutches, and the bearings; to cool the transmission; and to carry hydraulic signals and power. The hydraulic pressure controls the belt traction, transmission ratio, and clutch engagement. The lubricant must provide the appropriate degree of friction between the belt and pulley assembly, to avoid the problem of slippage on one hand, and binding on the other, all the while providing protection to the metal surfaces from pitting, scuffing, scratching, flaking, polishing, and other forms of wear. Accordingly, the fluid should maintain a relatively high coefficient of friction for metal/metal contact, as well as exhibiting a suitable degree of shear stability.

Traction drives can be seen as another species of continuously variable transmission. These are typically devices in which power or torque is transmitted from an input element to an output element through nominal point or line contact, typically with a rolling action, by virtue of the traction between the contacting elements. Traction fluids and traction drives in which they can be used have been described for instance, in U.S. Pat. Nos. 4,693,134 and 5,043,497. While the working elements of a traction drive are sometimes spoken of as being in contact, it is generally accepted that a fluid film must be provided therebetween. Traction fluids and traction fluid compositions are employed in this context to provide power transmission by shearing of the film.

The present invention, therefore, solves the problem of providing fluids such as fluids for push-belt type and other continuously variable transmissions, which have increased metal-on-metal coefficient of friction while exhibiting low copper corrosion, by incorporating an oil soluble zinc salt into a fluid which is substantially free from thiophosphate salts.

European Patent Application 287 618, Dec. 9, 1992, discloses functional fluid compositions which comprise metal salts of an alkyl phosphoric acid ester. The metal-containing high torque, extreme pressure agent for a lubricating composition is prepared by reacting (A) a compound of the formula ROH with (B) a sulfur-free, phosphorus-containing agent to form an intermediate, and then further reacting said intermediate with (C) an oxide or hydroxide . . . of a metal selected from . . . zinc [among others] in the presence of (D) a catalytically effective amount of a proton source. The phosphorus acid esters are usually prepared from alcohols or alkyl phenols and phosphorus pentoxide. The amount of the composition employed in a lubricant will be about 0.05% to about 20%, preferably about 0.1% to about 10%.

U.S. Pat. No. 3,803,037, Wygant, Apr. 9, 1974, discloses cyclic carbon-containing compounds suited for use as a fluid component of tractive drives. The load-bearing capability is improved by incorporating minor amounts of zinc di(neo-alkyl)phosphorodithioate. In a (comparative) example, 2% of zinc 2-ethylhexyl isopropyl phosphorodithioate was tested and the coefficient of traction was measured.

SUMMARY OF THE INVENTION

The present invention provides a method for lubricating a continuously variable transmission, comprising supplying to said transmission a composition comprising an oil of lubricating viscosity and an oil-soluble zinc salt containing at least one hydrocarbyl group of at least 4 carbon atoms, in an amount sufficient to provide an increased steel-on-steel dynamic coefficient of friction for said composition, said coefficient of friction being at least 0.125, provided that said composition is substantially free from thiophosphate salts. The resulting composition exhibits a copper corrosion rating of 1B or better as measured by the procedure of ASTM-130 at 149° C. for 3 hours.

DETAILED DESCRIPTION OF THE INVENTION

Various preferred features and embodiments will be described below by way of non-limiting illustration.

The present invention provides a method for lubricating a continuously variable transmission (CVT). CVTs include both automotive and industrial transmissions, and include transmissions of both the push-belt design and the traction drive design.

The continuously variable transmissions of the present invention are lubricated by supplying to them a fluid. The fluid serves as more than a conventional lubricant since it must provide appropriate frictional or traction performance, and it can thus also be considered to be a functional fluid. The fluid composition comprises, first, an oil of lubricating viscosity, which is generally present in a major amount (i.e. an amount greater than 50% by weight). Generally, the oil of lubricating viscosity is present in an amount of greater than 80% by weight of the composition, typically at least 85%, preferably 90 to 98%. Such oil can be derived from a variety of sources, and includes natural and synthetic lubricating oils and mixtures thereof.

The natural oils useful in making the inventive lubricants and functional fluids include animal oils and vegetable oils (e.g., lard oil, castor oil) as well as mineral lubricating oils such as liquid petroleum oils and solvent treated or acid-treated mineral lubricating oils of the paraffinic, naphthenic or mixed paraffinic/naphthenic types which may be further refined by hydrocracking and hydrofinishing processes and are dewaxed. Oils of lubricating viscosity derived from coal or shale are also useful. Useful natural base oils may be those designated by the American Petroleum Institute (API) as Group I, II, or III oils. Group I oils contain <90% saturates and/or >0.03% sulfur and have a viscosity index (VI) of ≧80. Group II oils contain ≧90% saturates, ≦0.03% sulfur, and have a VI ≧80. Group III oils are similar to group II but have a VI ≧120.

Upon occasion, highly refined or hydrocracked natural oils have been referred to as "synthetic" oils. More commonly, however, synthetic lubricating oils are understood to include hydrocarbon oils and halo-substituted hydrocarbon oils such as polymerized and interpolymerized olefins (e.g., polybutylenes, polypropylenes, propylene-isobutylene copolymers, chlorinated polybutylenes); poly(1-hexenes), poly(1-octenes), poly(1-decenes), and mixtures thereof; alkyl-benzenes (e.g., dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulfides and the derivatives, analogs and homologs thereof and the like. Polyalpha olefin oils are also referred to as API Group IV oils.

Alkylene oxide polymers and interpolymers and derivatives thereof where the terminal hydroxyl groups have been modified such as by esterification or etherification constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of 500–1000, or diethyl ether of polypropylene glycol having a molecular weight of 1000–1500) or mono- and polycarboxylic esters thereof, for example, the acetic acid esters, mixed $C_{3-8}$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, or alkenyl malonic acids) with a variety of alcohols (e.g., butyl alcohol, hexyl alcohol, dodecyl alcohol, 2-ethylhexyl alcohol, ethylene glycol, diethylene glycol monoether, or propylene glycol). Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, or tripentaerythritol.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butylphenyl)silicate, hexyl-(4-methyl-2pentoxy) disiloxane, poly(methyl)siloxanes, poly-(methyl-phenyl) siloxanes). Other synthetic lubricating oils include liquid esters of phosphorus-containing acids (e.g., tricresyl phosphate, trioctyl phosphate, diethyl ester of decane phosphonic acid), polymeric tetrahydrofurans and the like.

Unrefined, refined, and rerefined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, hydroprocessing, hydrocracking, and hydrotreating. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

In one embodiment, the oil of lubricating viscosity is a poly-alpha-olefin (PAO). Typically, the poly-alpha-olefins are derived from monomers having from 4 to 30, or from 4 to 20, or from 6 to 16 carbon atoms. Examples of useful PAOs include those derived from 1-decene. These PAOs may have a viscosity from 2 to 150.

Preferred base oils include poly-$\alpha$-olefins such as oligomers of 1-decene. These synthetic base oils are hydrogenated resulting in an oil of stability against oxidation. The synthetic oils may encompass a single viscosity range or a mixture of high viscosity and low viscosity range oils so long as the mixture results in a viscosity which is consistent with the requirements set forth below. Also included as preferred base oils are highly hydrocracked and dewaxed oils. These petroleum oils are generally refined to give enhanced low temperature viscosity and antioxidation performance. Mixtures of synthetic oils with refined mineral oils may also be employed.

Another class of oils is known as traction oils or traction fluids, which are typically synthetic fluids containing a large fraction of highly branched or cycloaliphatic structures, e.g., cyclohexyl rings. Traction fluids are described in detail, for example, in U.S. Pat. Nos. 3,411,369 and 4,704,490. Certain types of base fluids are particularly suited for use in traction fluids because of their inherently good (high) traction coefficients. Two types of base fluids which are particularly suitable are (1) polymers of at least one olefin which contains 3 to 5 carbon atoms, and (2) hydrocarbon molecules containing non-aromatic cyclic moieties. Mixtures of these types of materials can also be used. For suitable performance, the base fluid should preferably have a viscosity of greater than $2.5\times10^{-6}$ $m^2/s$ (2.5 cSt) at 100° C. (ASTM D-445), and more preferably a viscosity of at least $3.0\times10^{-6}$ $m^2/s$ (3.0 cSt) or $3.5\times10^{-6}$ $m^2/s$ (3.5 cSt), typically up to $8.0\times10^{-6}$ $m^2/s$ (8.0 cSt) or $7.0\times10^{-6}$ $m^2/s$ (7.0 cSt) or $6.0\times10^{-6}$ $m^2/s$ (6.0 cSt) at 100° C.

Suitable base fluids of type (1) include polymers of branched olefins, preferably isobutylene, particularly those having a number average molecular weight of 180 to 2000, preferably 200 to 1000 or to 700. The polymer is preferably hydrogenated to remove any residual unsaturation. Such materials and their preparation are well known and are described, for instance, in U.S. Pat. No. 3,966,624, as component A, described particularly in column 12 line 32 through column 16 line 11.

Suitable base fluids of type (2) include a wide variety of cyclic-containing hydrocarbon molecules. Examples of these include di(cyclohexyl)alkanes, cyclohexyl hydrindans and adamantane compounds, as described in U.S. Pat. No. 3,966,624; esters of cyclohexanol and cylohexanecarboxylic acid, as described in U.S. Pat. No. 4,871,476; decalin, cycohexyldecalin, alkyl-substituted decalin, alkyl-substituted cyclohexyldecalin, and mixtures thereof, as described in U.S. Pat. No. 3,803,037; various materials having two cyclohexane rings linked by a methylene group described in U.S. Pat. No. 5,043,497; various hydrocarbon compounds having a bicyclooctane skeleton described in U.S. Pat. No. 5,422,027; hydrogenated products of dimers, trimers, or tetramers of norbornanes and/or norbornenes described in U.S. Pat. No. 5,126,065; hydrogenated dimers, trimers, or polymers of cyclic monoterpenoid monomers described in U.S. Pat. No. 4,975,215; various ter-cyclohexyl compounds disclosed in U.S. Pat. No. 5,850,745; perhydrofluorene derivatives disclosed in U.S. Pat. No. 4,774,013; and preferably linear dimers of hydrogenated α-alkyl styrene, as described in U.S. Pat. No. 3,975,278. Any of the above materials may be used in a hydrogenated form, to assure the removal of carbon unsaturation; indeed, certain hydrogenated styrene derivatives (or cyclohexane derivatives) are inherently hydrogenated species. However, aromatic cyclic structures such as those derived from styrene may also be present in the base fluid, since aromatic cyclic structures are generally considered to be less deleterious than olefinic unsaturation.

The preferred materials for option (2) of the base fluid are predominantly linear dimers of hydrogenated α-alkyl styrene. These dimers are said to be predominantly linear, in contrast to the cyclic dimers which represent another possible structure. Such preferred materials can be represented by the general structure

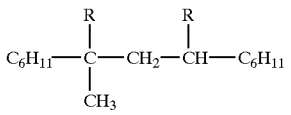

wherein each R is an alkyl group of 1 to 4 carbon atoms and $C_6H_{11}$ represents a cyclohexyl group. Such materials and their preparation are described in detail in U.S. Pat. No. 3,975,278. Indeed, the base fluid for the present composition preferably contains a major proportion of compounds represented as shown above.

Another component of the present fluid composition is an oil soluble zinc salt. There is no particular restriction on the type of zinc salt; however, it should not be a zinc thiophosphate or dithiophosphate material. While zinc dihydrocarbyldithiophosphates (ZDDPs) are widely known in the lubricating art, they should not be present in the present composition except perhaps in small and inconsequential amounts. Indeed, the lubricating composition should be substantially free from any thiophosphate derivatives, in order to provide a composition which exhibits minimal copper corrosion. In one embodiment, the lubricating composition is substantially free from compounds of all types containing active sulfur atoms. By "active sulfur atoms" is meant sulfur atoms which are available (or are sufficiently labile to become available) to react with metal parts of a transmission. Besides elemental sulfur, materials which may contain or may generate active sulfur atoms include common anti-wear agent including sulfurized olefins, thiocarbamates, and dithiocarbamates. By "substantially free" it is meant that the amount of the thiophosphate material is sufficiently low as to have no practically measurable effect on performance of the fluid, with regard to copper corrosion. In numerical terms this would normally correspond to an amount of zinc dialkyldithiophosphate of less than 200 parts per million in the composition, preferably less than 50 or 10 p.p.m.

Copper corrosion is measured by ASTM standard test number 130. The compositions used in the present invention, formulated to be substantially free from thiophosphate salts, will exhibit a copper corrosion rating of 1B or better when tested for 3 hours at 149° C.

Oil-soluble zinc salts will be species which contain at least one hydrocarbyl group of at least 4, and preferably at least 6, carbon atoms. The hydrocarbyl group will generally be required in order to provide the required oil solubility, and its particular length or other characteristics may vary depending on the type of zinc salt involved. Suitable zinc salts include zinc phosphates, phosphites, phosphonates, sulfonates, carboxylates, phenates, and salicylates.

In one embodiment, the zinc salt is a zinc hydrocarbyl phosphate. The phosphate can be a mono- or dihydrocarbyl phosphate. The hydrocarbyl groups typically each independently contain 1 to 30 carbon atoms, preferably 1 to 24 carbon atoms, more preferably 1 to 12 carbon atoms, provided, as stated above, that at least one hydrocarbyl group contains at least 6 carbon atoms. In a preferred embodiment, each hydrocarbyl is independently an alkyl or aryl group. When any group is an aryl group it typically contains 6 to 24 carbon atoms, more preferably 6 to 18 carbon atoms. Examples of hydrocarbyl groups include a butyl, amyl, hexyl, octyl, oleyl or cresyl, with octyl and cresyl being preferred.

The zinc hydrocarbyl phosphates can be prepared by reacting phosphorus acid or anhydride, preferably phosphorus pentoxide, with an alcohol at a temperature of 30° C. to 200° C., preferably 80° C. to 150° C., followed by neutralization with a zinc base. The phosphorus acid is generally reacted with the alcohol in a ratio of about 1:3.5, preferably 1:2. The product of such a reaction typically comprises a mixture of monohydrocarbyl and dihydrocarbyl zinc phosphates, typically being present in a relative ratios of about 1:1, or more generally, 2:1 to 1:2 or 3:1 to 1:3. Mixtures of about 1:1 monohydrocarbyl: dihydrocarbyl materials can be prepared by the simple stoichiometric reaction of alcohol with $P_2O_5$:

$$3ROH+P_2O_5 \rightarrow RO—P(=O)—(OH)_2+(RO)_2—P(=O)—OH$$

The alcohol can be any of the commercially available alcohols having an appropriate chain length, or mixtures of such alcohols. The alcohols can be aliphatic, cycloaliphatic, aromatic, or heterocyclic, including aliphatic-substituted cycloaliphatic alcohols, aliphatic-substituted aromatic alcohols, aliphatic-substituted heterocyclic alcohols, cycloaliphatic-substituted aliphatic alcohols, cycloaliphatic-substituted aromatic alcohols, cycloaliphatic-substituted heterocyclic alcohols, heterocyclic-substituted aliphatic alcohols, heterocyclic-substituted cycloaliphatic alcohols, and heterocyclic-substituted aromatic alcohols. The alcohols may contain non-hydrocarbon substituents of a type which do not interfere with the reaction of the alcohols with the phosphorus compound. The alcohols can be monohydric alcohols such as methanol, ethanol, isooctanol, 2-ethylhexanol, dodecanol, and cyclohexanol. Alternatively, the alcohols can be polyhydric alcohols, such as alkylene polyols such as ethylene glycols, including di-, tri- and tetraethylene glycols; propylene glycols, including di-, tri- and tetrapropylene glycols; glycerol; and the like. Also useful alcohols are mixed $C_{18}$–$C_{28}$ primary alcohols having mostly, on an alcohol basis, $C_{22}$ alcohols. A variety of mixtures of monohydric fatty alcohols derived from naturally occurring triglycerides and ranging in chain length of from $C_8$ to $C_{18}$ are also useful, and are available from various sources including Procter & Gamble Company.

Another category of zinc salts includes the zinc carboxylates. These can be seen as the neutralization product of a zinc base and a carboxylic acid. As before, the carboxylic acid should contain at least 6 carbon atoms, to provide appropriate solubility. The carboxylic acids can be aliphatic or aromatic, mono- or polycarboxylic acids (or acid-producing compounds). These carboxylic acids include lower molecular weight carboxylic acids as well as higher molecular weight carboxylic acids (e.g. having more than 8 or more carbon atoms). Usually, in order to provide the desired solubility, the number of carbon atoms in a carboxylic acid should be at least about 8, e.g., 8 to 400, preferably 10 to 50, and more preferably 10 to 22.

Carboxylic acids include saturated and unsaturated acids. Examples of useful acids include dodecanoic acid, decanoic acid, tall oil acid, 10-methyl-tetradecanoic acid, 3-ethylhexadecanoic acid, and 8-methyl-octadecanoic acid, palmitic acid, stearic acid, myristic acid, oleic acid, linoleic acid, behenic acid, hexatriacontanoic acid, tetrapropylenyl-substituted glutaric acid, polybutenyl-substituted succinic acid derived from a polybutene ($\overline{Mn}$=200–1500), polypropenyl-substituted succinic acid derived from a polypropene, ($\overline{Mn}$=200–1000), octadecyl-substituted adipic acid, chlorostearic acid, 12-hydroxystearic acid, 9-methylstearic acid, dichlorostearic acid, ricinoleic acid, lesquerellic acid, stearyl-benzoic acid, eicosanyl-substituted naphthoic acid, dilauryl-decahydronaphthalene carboxylic acid, mixtures of any of these acids, their alkali and alkaline earth metal salts, their ammonium salts, their anhydrides, or their esters or triglycerides. A preferred group of aliphatic carboxylic acids includes the saturated and unsaturated higher fatty acids containing from about 12 to 30 carbon atoms. Other acids include aromatic carboxylic acids including substituted and non-substituted benzoic, phthalic and salicylic acids or anhydrides, most especially those substituted with a hydrocarbyl group containing about 6 to 80 carbon atoms. Examples of suitable substituent groups include butyl, isobutyl, pentyl, octyl, nonyl, dodecyl, and substituents derived from the above-described polyalkenes such as polyethylenes, polypropylenes, polyisobutylenes, ethylene-propylene copolymers, and oxidized ethylene-propylene copolymers.

An especially preferred zinc carboxylate is zinc oleate, which can be prepared by the neutralization of oleic acid by a basic zinc compound. Another zinc carboxylate is zinc salicylate.

The zinc compound can be a simple (neutral) salt, generally formed by straightforward stoichiometric acid-base neutralization of the acid with a zinc base such as zinc oxide or zinc hydroxide. The zinc salt can also be an overbased salt. Alternatively, the zinc salt can be a basic salt, in which one equivalent of a zinc base is reacted with somewhat less than one equivalent of acid, as described, for instance, in U.S. Pat. No. 5,110,488 (columns 9 and 10). An example of such a material is a slightly "over-zinc-ed" oleate, that is, $Zn_4Oleate_3O_1$. This is a species of overbased materials in general, which are well known to those skilled in the art and are generally disclosed in numerous patents such as U.S. Pat. No. 3,492,231 and especially the references cited therein.

The amount of the oil-soluble zinc salt should be sufficient to impart an increased steel-on-steel dynamic coefficient of friction for the formulation of at least 0.125, preferably 0.125 or 0.127 to 0.150, more preferably 0.130 to 0.140 or 0.135. The corresponding static coefficient of friction is 0.14 to 0.2 The coefficients of friction are measured at 110° C. by ASTM G-77. The coefficient of friction of the formulation is improved, that is, increased over that of the same composition without the zinc salt.

The preferred amount of the oil soluble zinc salt, differently stated, is 0.05 to 1.0 percent by weight of the lubricant composition, preferably 0.2 to 0.5 weight percent. The zinc salt will preferably contribute up to 0.15 weight percent zinc to the composition, more preferably 0.01 to 0.1 weight percent.

The fluid used in the present invention may and will typically contain one or more additional additives suitable for use in a continuously variable transmission or an automatic transmission fluid (ATF). Such additional materials include other friction modifiers; and antioxidants, including hindered phenolic antioxidants, secondary aromatic amine antioxidants, oil-soluble copper compounds, and phosphorus-containing antioxidants. Other components include metal deactivators such as tolyltriazole, benzotriazole, and the methylene-coupled product of tolyltriazole and amines such as 2-ethylhexylamine. Such metal deactivators can also be useful in adjusting the metal-to-metal friction in push belt CVTs. Other components can include seal swell compositions, such as isodecyl sulfolane (that is, isodecyl-3-sulfolanyl ether), which are designed to keep seals pliable. Also permissible are pour point depressants, such as alkyl-naphthalenes, polymethacrylates, vinyl acetate/fumarate or /maleate copolymers, and styrene/maleate copolymers. Also included can be corrosion inhibitors, dyes, fluidizing agents, antifoam agents, dispersants, detergents, and anti-wear agents. These optional materials are known to those skilled in the art, are generally commercially available, and many are described in greater detail in published European Patent Application 761,805. Each of these materials may be present in conventional and functional amounts.

The composition of the present invention will normally be supplied as a fully formulated lubricant or functional fluid, or it can initially be prepared as a concentrate. In a concentrate, the relative amounts of the various components will generally be about the same as in the fully formulated composition, except that the amount of oil of lubricating viscosity will be decreased by an appropriate amount. The absolute percentage amounts of the remaining components will be correspondingly increased. Thus, when the concentrate is added to an appropriate amount of oil, the final formulation of the present invention will be obtained. A typical concentrate of the present invention may contain, for instance, 0.5 to 20 weight percent of the zinc salt, that is, about 10 times the concentration typically used in a final blend. An exhaustive listing of all the acceptable amounts and combinations in a concentrate on a parts-by-weight basis is not recited herein for the sake of brevity; however, such combinations can well be determined by the person skilled in the art seeking to prepare a concentrate.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Hydrocarbyl groups containing active sulfur may be avoided, if desired, to the extent that they may undesirably contribute to copper corrosion.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the composition prepared by admixing the components described above.

EXAMPLES

Example 1

Preparation of Zinc Hydrocarbyl Phosphate

To a flask containing 2-ethylhexanol is added an equivalent amount of $P_2O_5$ in multiple portions, with stirring, over approximately ⅔ hour, at a temperature range of 65–96° C. The mixture is maintained at 85° C. for 6 hours and then 105° C. for 5 hours to provide the mixture of 2-ethylhexyl phosphoric acids. To a solution of this phosphorus acid composition in oil, containing 5 mole % water (based on the acid) and 5 mole % acetic acid is added 1.05 equivalents of zinc oxide. The mixture is heated with stirring at 60° C. for 1 hour, then 80° C. for 1 hour, and then stripped at 700 Pa (5 mm Hg) at 80° C. over 5 hours. Filtration through a filter aid yields the desired zinc salt.

A fluid for use in automatic transmissions or CVTs is prepared which contains, in a mixed hydrocarbon oil basestock, conventional additives including a polymeric viscosity modifier, succinimide dispersants, amine and hydrocarbyl sulfide antioxidants, an overbased calcium sulfonate, and phosphorus compounds (dialkyl hydrogen phosphite, alkyl hydrogen phosphonate, phosphoric acid) and other component at conventional levels. The copper corrosion performance and friction properties of these samples are measured and reported in the Table below:

| Ex. | Zinc salt, % | Cu corrosion (ASTM D130, 3 hr, 149° C.) | Coefficient of Friction (Element on Ring, ASTM-G-77) |
|---|---|---|---|
| 2[a,b] | none | 1A | 0.125 |
| 3[a,b] | zinc dialkyl dithiophosphate, 0.7 | 4B | 0.130 |
| 4[a] | Prod of Ex. 1, 0.6 | 1B | 0.132 |
| 5[a] | Prod of Ex. 1, 0.3 | 1B | 0.127 |
| 6[b] | none | | 0.124 |
| 7 | zinc oleate[c], 0.1 | 1B | 0.136, 0.133 |

[a]formulation also contains 0.2% borated ester friction modifier
[b]reference example
[c]slightly basic, 13.1% Zn It is noted that the presence of the zinc salts in Examples 4, 5, and 7 leads to an increase in coefficient of friction, while retaining good copper corrosion performance.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined. As used herein, the expression "consisting essentially of" permits the inclusion of substances which do not materially affect the basic and novel characteristics of the composition under consideration.

What is claimed is:

1. A method for lubricating a continuously variable transmission which comprises a region of metal/metal contact, comprising supplying to said transmission a composition comprising an oil of lubricating viscosity and an oil-soluble zinc salt containing at least one hydrocarbyl group of at least 4 carbon atoms, comprising at least one zinc phosphate or at least one zinc salt of a lower carboxylic acid having 6 to 8 carbon atoms, in an amount sufficient to provide an increased steel-on-steel dynamic coefficient of friction for said composition, said coefficient of friction being at least 0.125, provided that said composition is substantially free from thiophosphate salts, whereby said composition exhibits a copper corrosion rating of 1B or better as measured by the procedure of ASTM-130 at 149° C. for 3 hours.

2. The method of claim 1 wherein the composition is substantially free from compounds containing active sulfur atoms.

3. The method of claim 1 wherein the amount of the mixture of said oil-soluble zinc salt is sufficient to provide a dynamic coefficient of friction of about 0.125 to about 0.150 and a static coefficient of friction of about 0.14 to about 0.2.

4. The method of claim 1 wherein the amount of the oil-soluble zinc salt is about 0.05 to about 1.0 percent by weight.

5. The method of claim 1 wherein the amount of oil-soluble zinc salt is at least about 0.2 percent by weight.

6. The amount of claim 1 wherein the amount of oil-soluble zinc salt is at least about 0.3 percent by weight.

7. The method of claim 1 wherein the oil-soluble zinc salt contributes up to about 0.15 weight percent zinc to the composition.

8. The method of claim 1 wherein the oil-soluble zinc salt contributes about 0.01 to about 0.1 weight percent zinc to the composition.

9. The method of claim 1 wherein the oil-soluble zinc salt comprises a zinc carboxylate.

10. The method of claim 1 wherein the oil of lubricating viscosity comprises a traction fluid.

11. The method of claim 1 wherein the composition supplied to said transmission further comprises at least one additional additive suitable for use in a continuously variable automatic transmission.

12. The method of claim 1 wherein the continuously variable transmission is a push-belt transmission.

13. The method of claim 1 wherein the continuously variable transmission comprises a region of metal/metal contact.

14. A transmission lubricant composition comprising an oil of lubricating viscosity and an oil-soluble zinc salt containing at least one hydrocarbyl group of at least 4 carbon atoms, comprising at least one zinc phosphate or at least one zinc salt of a lower carboxylic acid having 6 to 8 carbon atoms, in an amount sufficient to provide an increased steel-on-steel dynamic coefficient of friction for said composition, said coefficient of friction being at least 0.125, provided that said composition is substantially free from thiophosphate salts, whereby said composition exhibits a copper corrosion rating of 1B or better as measured by the procedure of ASTM-130 at 149° C. for 3 hours.

15. The composition of claim 14 wherein the zinc salt is a zinc phosphate and each hydrocarbyl group in the zinc phosphate contains up to 12 carbon atoms.

16. A method for lubricating a continuously variable transmission which comprises a region of metal/metal contact, comprising supplying to said transmission a composition comprising an oil of lubricating viscosity and an oil-soluble zinc salt containing at least one hydrocarbyl group of at least 4 carbon atoms, comprising at least one zinc phosphate in an amount sufficient to provide an increased steel-on-steel dynamic coefficient of friction for said composition, said coefficient of friction being at least 0.125, provided that said composition is substantially free from thiophosphate salts, whereby said composition exhibits a copper corrosion rating of 1B or better as measured by the procedure of ASTM-130 at 149° C. for 3 hours.

17. The method of claim 16 wherein the zinc phosphate is a mixture of monohydrocarbyl and dihydrocarbyl zinc phosphates.

18. The method of claim 17 wherein the hydrocarbyl groups comprise at least one alkyl group.

19. The method of claim 18 wherein the alkyl group is a 2-ethylhexyl group.

20. The method of claim 18 wherein the mono- and di-hydrocarbyl zinc phosphates are present in relative molar amounts of about 3:1 to about 1:3.

21. The method of claim 16 wherein each hydrocarbyl group in the zinc phosphate contains up to 12 carbon atoms.

* * * * *